United States Patent [19]

Gutekunst et al.

[11] 4,428,298

[45] Jan. 31, 1984

[54] VEHICLE SPEED CONTROL TRANSITION MODULE

[75] Inventors: Stanley K. Gutekunst, Nazareth; John M. Sipos, Easton, both of Pa.

[73] Assignee: SI Handling Systems, Inc., Easton, Pa.

[21] Appl. No.: 330,352

[22] Filed: Dec. 14, 1981

[51] Int. Cl.[3] ..... B61B 13/12

[52] U.S. Cl. ..... 104/166; 74/89; 104/250; 104/252

[58] Field of Search ..... 104/118, 165, 166, 249, 104/250, 252; 74/25, 89, 661; 192/48.9, 87.14; 464/23, 30, 179, 182

[56] References Cited

U.S. PATENT DOCUMENTS

| | | | |
|---|---|---|---|
| 423,872 | 3/1890 | Judson | 104/166 |
| 1,019,283 | 3/1912 | Surcouf | 74/661 |
| 3,356,040 | 12/1967 | Fonden | 104/130 |
| 3,818,837 | 6/1974 | Jacoby et al. | 104/166 |
| 4,041,873 | 8/1977 | Jones | 104/252 X |
| 4,244,455 | 1/1981 | Loker | 464/23 X |
| 4,319,662 | 3/1982 | Liston | 192/48.9 X |
| 4,357,875 | 11/1982 | Scheel | 104/166 |

*Primary Examiner*—Randolph Reese

*Attorney, Agent, or Firm*—Seidel, Gonda & Goldhammer

[57] ABSTRACT

The speed of a driverless vehicle is controlled along the length of the module from an incoming high speed to an outgoing low speed or vice versa. The module includes first, second and third aligned drive tubes between tracks adapted to support a vehicle. A first motor is coupled to the first drive tube for driving the same at a first high speed. A second drive motor is coupled to the third drive tube for driving the same at a second low speed. Clutch means are provided for enabling only the first motor to drive said first and second tubes and then enable only the second motor to drive the second and third tubes.

9 Claims, 4 Drawing Figures

VEHICLE SPEED CONTROL TRANSITION MODULE

BACKGROUND

A system of driverless vehicles driven by frictional contact between a drive tube and a drive wheel on the vehicle is disclosed in U.S. Pat. No. 3,356,040. A vehicle of the type adapted for use herein is taught by U.S. Pat. No. 3,818,837. The present invention is directed to a solution of the problems of how to automatically reduce or increase the speed of a driverless vehicle as it moves along the tracks of a conveyor.

SUMMARY OF THE INVENTION

The present invention is directed to apparatus for controlling the speed of a driverless vehicle. The apparatus includes a frame for supporting first, second and third aligned drive tubes between tracks adapted to support a vehicle. A first motor is coupled to the first drive tube for rotating the same about its longitudinal axis at a first speed. A second motor is coupled to the third drive tube for rotating the same about its longitudinal axis at a second speed substantially different from the first speed.

A cam means is provided along the second drive tube for slowing down or stopping a vehicle as the vehicle moves along the second drive tube. A clutch means is provided for selectively enabling only the first motor to drive said first and second drive tubes and then enable only the second motor to drive the second and third drive tubes.

It is an object of the present invention to provide a speed control module for controlling the speed of a driverless vehicle from a high speed to a low speed and vice versa in an automatic manner which is simple and reliable.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
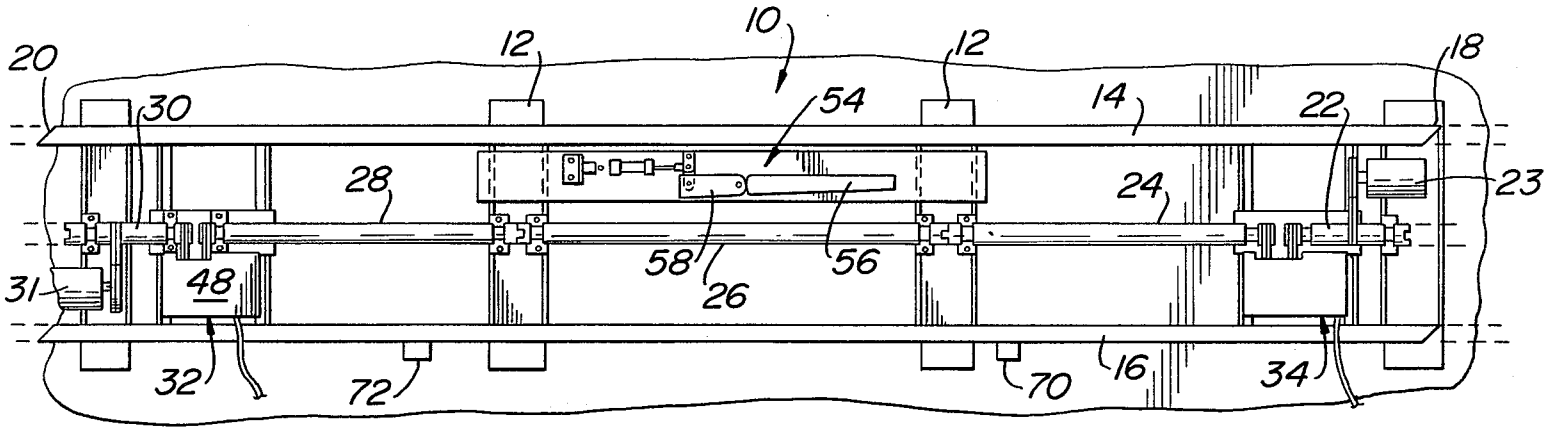
FIG. 1 is a top plan view of a speed control transition module in accordance with the present invention.

Referring to the drawings in detail, wherein like numerals indicate like elements, there is shown in FIG. 1 a speed control transition module in accordance with the present invention designated generally as 10. Module 10 is one module of a conveyor system and is located at an area of the system wherein it is desired to substantially increase or decrease the speed of the driverless vehicle. A typical module length is 20 feet.

For purposes of describing the present invention, it will be assumed that the vehicle moves from right to left in FIG. 1 and enters the module at a high speed. The system will be described in a manner so that the vehicle will exit from the module 10 at a low speed. Representative figures for high and low speeds are 200 feet per minute and 5 feet per minute.

The module 10 includes a frame 12 of any suitable construction for supporting the module above ground level. The frame 12 supports rails 14 and 16 for rolling contact with support wheels on a driverless vehicle. One end of the module designated 18 is the inlet end and the exit end is identified as 20. At the inlet end 18, there is provided a first drive tube 22 driven at a high speed by a first drive motor 23 having an output pulley contacted to the tube 22 by belts. Tube 22 is aligned with a second drive tube which may be one single tube or may be comprised of aligned segments 24, 26 and 28 coupled together as illustrated.

Adjacent the exit end 20, the module 10 is provided with a third drive tube designated 30. Drive tube 30 is driven at a slow speed by a second motor 31 having its output pulley connected by way of belts to the drive tube 30. Drive tube 30 is selectively coupled to segment 28 of the second drive tube by way of a clutch assembly 32. Drive tube 22 is connected to segment 24 of the second drive tube by way of a clutch assembly 34. The clutch assemblies 32 and 34 are identical. Hence, only clutch assembly 32 will be described in detail.

Figure 2:
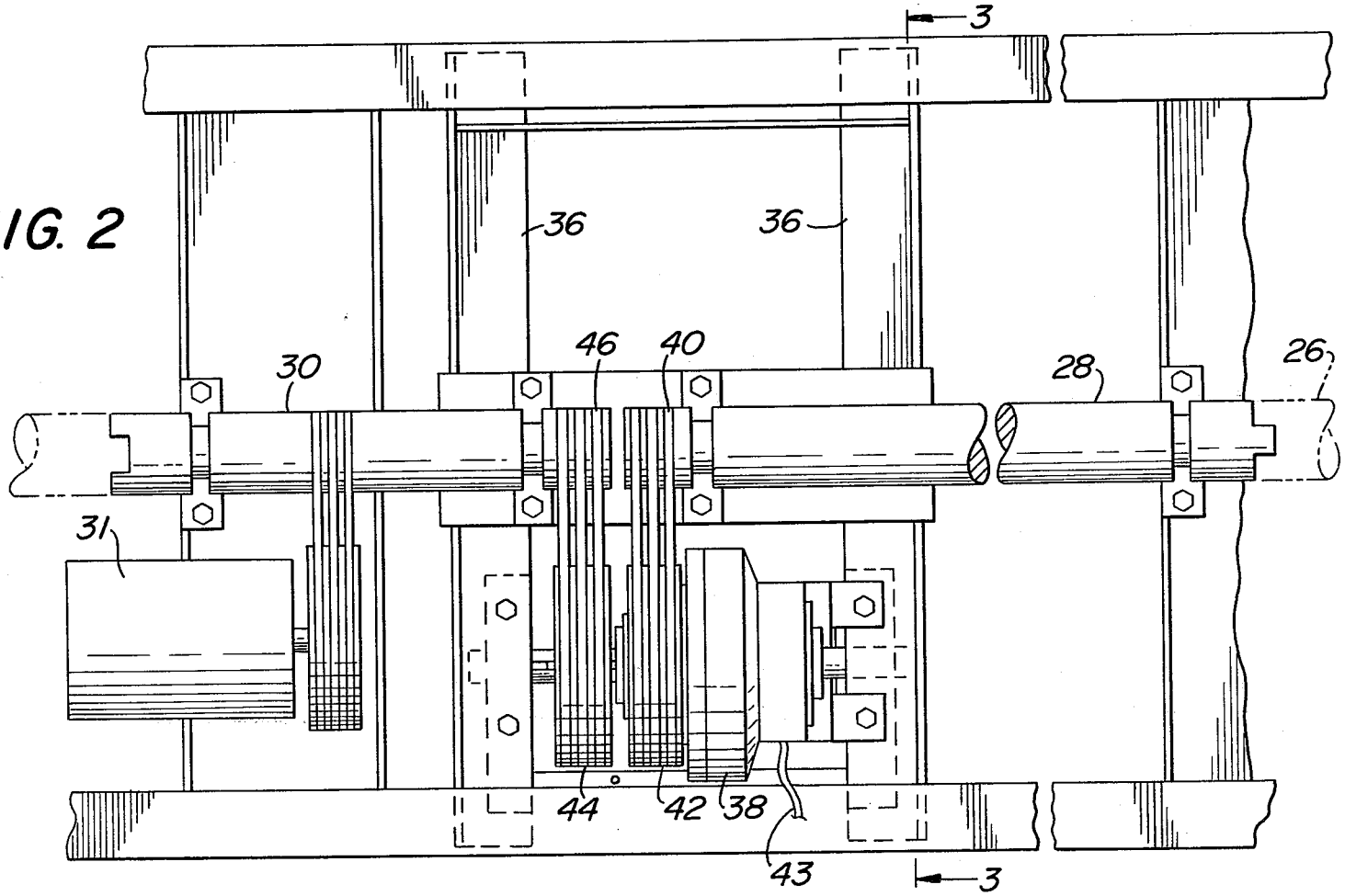
FIG. 2 is an enlarged plan view of one end of the module shown in FIG. 1.
Figure 3:
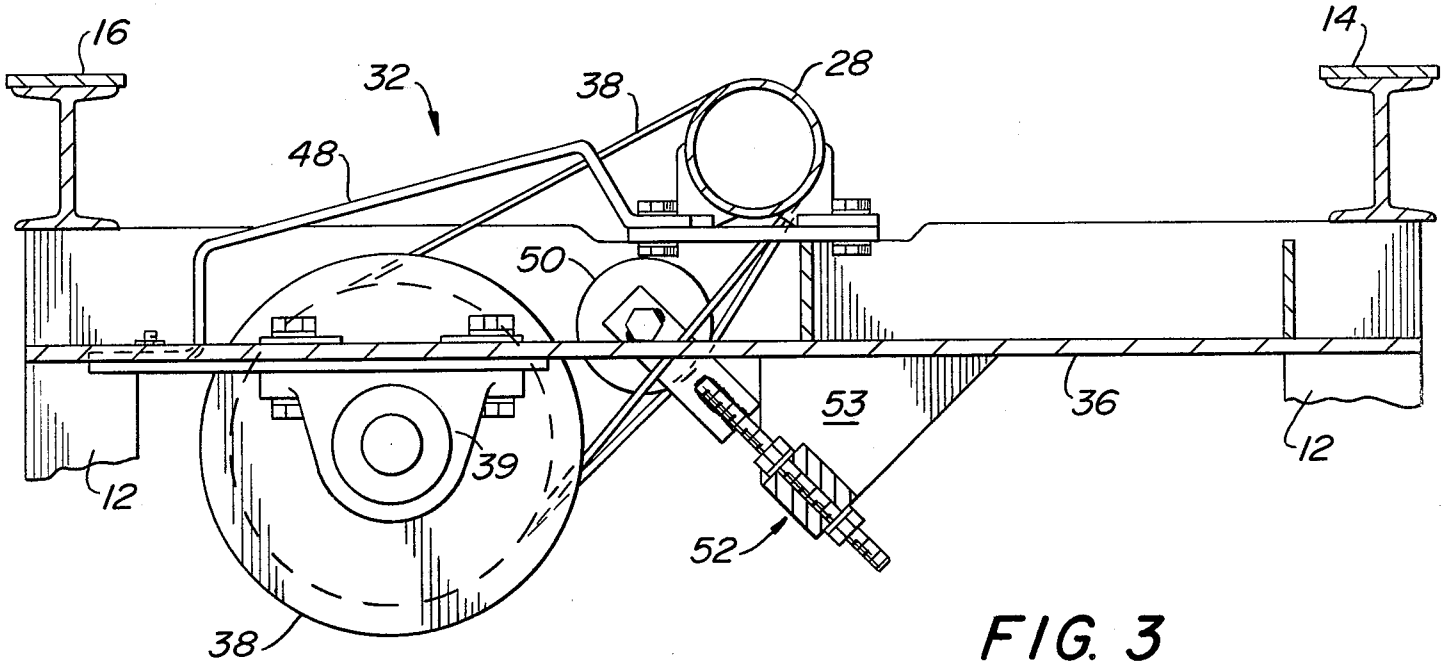
FIG. 3 is a sectional view taken along the line 3—3 in FIG. 2.

Referring to FIGS. 2 and 3, support members 36 extend across the frame below the elevation of the tracks. A clutch 38 has its shaft supported by a pillow block 39 on each of the members 36. Belts 40 extend around the output pulley 42 of the clutch 38 and the segment 28 of the second drive tube. The clutch 38 is preferably an air clutch with air hose 43 connected thereto. When air is applied by hose 43, a disk connects pulley 42 to the shaft of the clutch and second pulley 44. Pulley 44 is connected to the third drive tube 30 by way of endless belts 46. Thus, when air is applied to the clutch 38, motor 31 drives the second drive tube 28 and the third drive tube 30.

The clutch assembly 32 may include a removable cover 48. See FIGS. 1 and 3. The cover 48 has been removed in FIG. 2 to facilitate illustration of the structure therebelow. If desired, the belts may be provided with a tension roller 50 adjustable by way of the tensioner 52 supported by the bracket 53 which depends from member 36.

Figure 4:
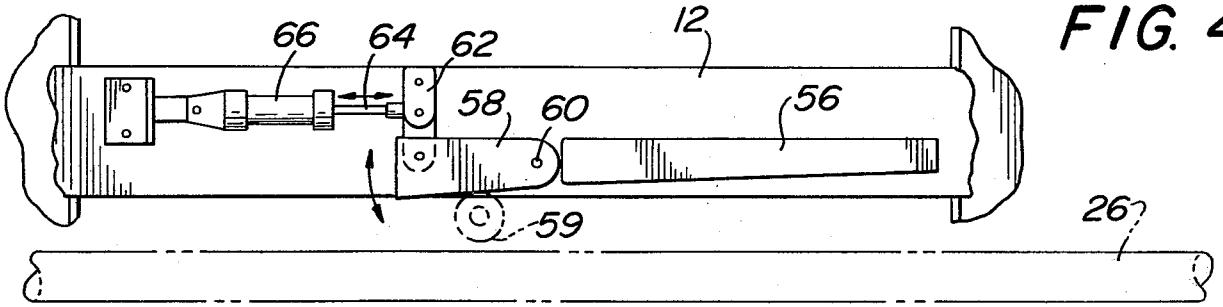
FIG. 4 is an enlarged view of the central portion of the module shown in FIG. 1.

Referring to FIGS. 1 and 4, the second drive tube includes a stop mechanism designated generally as 54. The stop mechanism 54 includes a first cam 56 which is stationary and a movable cam 58 forming a continuation thereof. Cam 58 is connected to the frame 12 by toggle links 62 which are preferably of the over-the-center type. The center of the links is pivotably connected by piston rod 64 to a piston in the fluid cylinder 66. The cams 56, 58 as shown in FIG. 4 are in a position to cause a vehicle to stop due to contact between the cams and a cam follower 59. The cam follower 59 is supported by a vehicle and adapted to move the drive wheel on the vehicle to a stop position while the cam follower 59 is in contact with the cam 58. At least two microswitches or proximity switches 70 and 72 are provided along the frame at predetermined locations.

The module 10 is utilized as follows. A driverless vehicle is transferred onto the module 10 under the influence of motor 23 rotating the drive tube 22 at a high speed. The clutch of assembly 34 is connected so that the second drive tube is also driven by motor 23. When the drive wheel of the vehicle is supported solely by the second drive tube, switch 70 is triggered by a portion of the vehicle. When switch 70 is triggered, the clutch in assembly 34 is disconnected and the cylinder 66 is pressurized to move cam 58 to the position shown in FIG. 4. As the vehicle moves along the tracks 14, 16, a cam follower 59 on the vehicle will contact the cams 56 and 58 and cause the vehicle to slow down to a slow speed which approximates the speed of the drive tube 30 or may cause the vehicle to completely stop. At this point, the vehicle will trigger switch 72.

When switch 72 is triggered, a valve is opened in connection with hose 43 to supply pneumatic pressure to the clutch 38 to thereby cause the clutch 38 to engage. Also, switch 72 will reverse the supply valve for cylinder 66 whereby it is vented and causes cam 58 to pivot in a clockwise direction in FIG. 4 thereby losing contact with the cam follower 59. Hence, the vehicle may now proceed toward the exit end 20 at a speed corresponding to the speed of drive tube 30 under the influence of motor 31. If the switches 70, 72 do not automatically reverse after a time interval, a third switch may be provided to reinstate the initial condition wherein the clutch of assembly 32 is disengaged and the clutch of assembly 34 is engaged. The next vehicle will be reduced in speed in the same manner as described above.

While the above description relates to slowing down a vehicle so that manufacturing steps may be performed on the work carried by the vehicle, the present invention may also be utilized to increase the speed of the vehicle as it moves along the conveyor. Thus, the present invention provides a speed control in the form of a transition module so that portions of a conveyor system may cause a driverless vehicle to move at a high speed while other portions of the system cause the vehicle to move at a slow speed. Depending upon the length of the module, the second drive tube may be a single tube or may be segmented into a plurality of segments as illustrated in the drawing and described above.

The present invention avoids wearing out drive wheels and avoids jolting a load on the vehicle when changing from one speed to another. The present invention enables the speed of the vehicle to be changed over a short distance such as 4 to 8 feet depending upon the entry speed, the weight of the load, and the length of the drive wheel assembly. Speed control is attained within 3 or 4 seconds while utilizing structural components which are simple, inexpensive and reliable.

The present invention may be embodied in other specific forms without departing from the spirit or essential attributes thereof and, accordingly, reference should be made to the appended claims, rather than the foregoing specification, as indicating the scope of the invention.

We claim:

1. Apparatus for controlling the speed of a driverless vehicle comprising a stationary frame having an upstream end and a downstream end, said frame supporting first, second and third aligned drive tubes between tracks which are adapted to support a driverless vehicle, the ends of said second tube being at all times spaced from the adjacent ends of the first and third tubes, a first motor coupled to the first drive tube for rotating the same about its longitudinal axis at a first speed, a second motor coupled to the third drive tube for rotating the same about its longitudinal axis at a second speed which is different from said first speed, control means along the second drive tube for slowing down a vehicle as the vehicle moves along the second drive tube, and clutch means for selectively enabling only the first motor to drive said first and second tubes at the same speed and then enable only the second motor to drive said second and third tubes at the second speed with a smooth transition between the first and second speeds.

2. Apparatus in accordance with claim 1 wherein said control means includes a stationary cam and a movable cam having an actuator, said movable cam in one position thereof forming a continuation of the stationary cam, said movable cam being downstream from said stationary cam.

3. Apparatus in accordance with claim 1 wherein said second drive tube is comprised of a plurality of coaxial segments coupled together for rotation as a unit.

4. Apparatus in accordance with claim 1 including a plurality of switches along the frame for actuation by a driverless vehicle, the switches being arranged to control the clutch means as a function of the location of a driverless vehicle along the length of the second drive tube.

5. Apparatus for automatically controlling the speed of a driverless vehicle comprising a stationary frame supporting first, second and third aligned drive tubes between tracks which are adapted to support a vehicle, means for enabling a vehicle to be propelled onto the second drive tube from the first drive tube at a first speed and then cause the vehicle to change its speed and then enable the vehicle to be driven off the second tube onto the third tube at a second speed which is different from the first speed, said means including a first motor coupled to the first drive tube for rotating the same about its longitudinal axis at the first speed, a second motor connected to the third tube for rotating the third tube about its longitudinal axis at the second speed, control means along the second drive tube for changing the speed of a vehicle as it moves along the second drive tube, a first clutch for selectively enabling the first drive tube to drive the second drive tube; a second clutch for selectively enabling the third drive tube to drive the second drive tube, switch means along the length of the frame for actuation by a vehicle moving along the second drive tube, said switch means being arranged to alternately cause engagement of the first and second clutch means with only one clutch means being engaged at any given time.

6. Apparatus in accordance with claim 5 wherein the second speed is substantially lower than the first speed.

7. Apparatus in accordance with claim 5 wherein the second speed is substantially higher than the first speed.

8. Apparatus for automatically controlling the speed of a driverless vehicle comprising a stationary frame module adapted to be coupled end to end with other stationary frame modules of a driverless vehicle conveyor system, said module frame having a drive tube between tracks which are adapted to support a vehicle, control means on said frame module for controlling the speed of a vehicle as the vehicle moves along the drive tube, a first clutch adjacent one end of the frame module for selectively enabling said drive tube to be driven by a first motor at a first speed, a second clutch, adjacent the opposite end of the frame module for selectively enabling said drive tube to be driven by a second motor at a second speed, switch means along the length of the module frame for actuation by a vehicle moving along the module frame, said switch means being arranged to alternately cause engagement of the first and second clutch means with only one clutch means being engaged in any given time so that a vehicle may be propelled onto the second drive tube at a first speed and exit therefrom at a second speed.

9. Apparatus in accordance with claim 8 wherein said drive tube is comprised of a plurality of coaxial segments connected end to end, with the combined length of said segments being less than the length of said frame module.

* * * * *